United States Patent [19]

Norton

[11] Patent Number: 4,503,874

[45] Date of Patent: Mar. 12, 1985

[54] FLOATING HEAD APPARATUS FOR SWIMMING POOL CLEANING SYSTEM

[76] Inventor: Rickie E. Norton, 1421 E. Garnet, Mesa, Ariz. 85204

[21] Appl. No.: 520,481

[22] Filed: Aug. 4, 1983

[51] Int. Cl.[3] ..... E04H 3/20; B08B 9/08

[52] U.S. Cl. ..... 134/167 R; 4/490; 210/169

[58] Field of Search ..... 134/167 R, 168 R, 179; 210/169; 15/1.7; 4/490

[56] References Cited

U.S. PATENT DOCUMENTS

| | | | |
|---|---|---|---|
| 3,032,044 | 5/1962 | Pansini | 134/168 R |
| 3,170,180 | 2/1965 | Winston et al. | 134/167 R |
| 3,291,145 | 12/1966 | Arneson | 134/167 R |
| 3,758,276 | 9/1973 | Bond et al. | 210/169 X |
| 3,765,432 | 10/1973 | Goodin | 4/490 |
| 3,796,373 | 3/1974 | Moore | 134/167 R |
| 3,883,366 | 5/1975 | Blumenfeld | 134/167 R |
| 3,926,667 | 12/1975 | Gibellina | 134/167 R |
| 4,087,286 | 5/1978 | Sexton et al. | 210/169 X |
| 4,105,557 | 8/1978 | Weatherholt | 210/169 |
| 4,281,995 | 8/1981 | Pansini | 134/167 R |
| 4,431,538 | 2/1984 | Selsted | 4/490 X |

*Primary Examiner*—Stephen Marcus

*Attorney, Agent, or Firm*—H. Gordon Shields

[57] ABSTRACT

A swimming pool cleaning system includes head apparatus which has a swivel connection to a floating water supply hose secured to the center hub of a floating head and also secured to the floating head is a circular rim which is disposed beneath the surface of the water. A cleaning whip extends downwardly into the pool from the head.

7 Claims, 3 Drawing Figures

FLOATING HEAD APPARATUS FOR SWIMMING POOL CLEANING SYSTEM

BACKGROUND OF THE INVENTION

1. Field of the Invention

This invention relates to swimming pool cleaning apparatus, and, more particularly, to a floating head for swimming pool cleaning apparatus which is designed primarily for above-the-ground swimming pools.

2. Description of the Prior Art

U.S. Pat. No. 3,170,180 discloses a floating head for a swimming pool cleaning system. The head includes provisions for discharging water to make the head move in the swimming pool. A conduit is secured to the head, and a plurality of whips are secured to the conduit. The whips move through the water, stirring up sediment to be removed by a recirculating filter system. The head comprises a floating ring designed to float on the top surface of the water.

U.S. Pat. No. 3,265,079 discloses a swimming pool head that floats on the surface of the water. The floating head includes paddle wheel-like arms which extend outwardly from the head. The head is designed to move about the inner periphery and the sides of the pool in a regular pattern or fashion.

U.S. Pat. No. 3,665,942 discloses another type of floating head for a swimming pool cleaning system with whips extending outwardly from the head. The head includes a swivel attachment and a jet or impeller for moving the head in the water, in addition to the whips. One embodiment of the apparatus also uses a rudder attached to the impeller for steering the apparatus in a random fashion in a swimming pool.

U.S. Pat. No. 3,718,148 discloses another type of floating head with a plurality of whips attached to the head. The head includes inflexible conduits for insuring that the head moves in a regular pattern around the periphery of the swimming pool. At the same time, a flexible conduit attached to the head carries the whips. The apparatus is designed to move around the periphery of the swimming pool in a regular pattern, as opposed to the random pattern of the apparatus of the present invention.

U.S. Pat. No. 3,758,276 discloses a floating head that has a plurality of whips attached to the head and are depending downwardly from the head. The apparatus also includes chlorinating material which is dispensed from the head as the head moves in the water. The head moves in a random manner, propelled by the water reaction of jets secured directly to the head.

U.S. Pat. No. 4,040,864 discloses a floating head which moves in a random fashion on the top surface of water in a swimming pool. A hose connected to the head extends to a bag which collects debris. The bag is either floatable or sinkable, for cleaning either the surface of the water or the bottom of the swimming pool.

U.S. Pat. No. 4,141,101 discloses a floatable swimming pool cleaning head which includes a water jet nozzle for moving the head on the surface of the water. The head is designed to be in rolling contact with the sides of the pool. Whips are also carried by the head. The head includes an indoor platform member and an outer float or wheel member.

U.S. Pat. No. 4,348,192 discloses a floating head which is propelled in a swimming pool by a jet drive. The jet drive for the head is associated with a water supply hose connected to the head. A plurality of jets connected to the supply hose both propels the head and performs the cleaning action in the water. The head moves in a random fashion on the surface of the water.

All of the above-described patents include cleaning heads which are designed to float generally on the top surface of water in a swimming pool. The swimming pools are all illustratively shown as being in-ground pools. The heads are all circular, and are designed primarily to be floats which operate in one of two ways. They either move in a random fashion in a swimming pool or else they move against the sides of the swimming pool and about the periphery of the swimming pool, dragging or carrying whips or other water jet means for stirring up the sediment in the swimming pool water for cleaning purposes.

None of the heads, and associated cleaning systems, are designed for above-ground swimming pools. Above-ground swimming pools have certain characteristics which are not conducive to standard cleaning techniques. In the first place, above-ground swimming pools generally include a vinyl liner supported on a framework. The use of the vinyl requires that stairs or steps for getting into and out of the water be suspended outwardly, away from the vinyl sides. The reason for maintaining the steps apart from the sides is the need to maintain the "hardware" spaced apart from the vinyl to insure that direct contact between "hardware" and the vinyl is minimized to prevent tearing, etc. of the vinyl.

A swimming pool cleaning head that tracks the sides of the pool, that is, around the periphery of the pool, and thus maintains rolling contact with the sides, is detrimental to the vinyl due to the relatively continuous contact. The relatively continuous contact increases the possibility of tears, etc., in the vinyl.

In addition, a swimming pool head that moves in a random fashion in a below-ground pool could get caught in the space between the vinyl liner sides and the steps in an above-the-ground swimming pool due to the relatively large spacing or distance between the steps and the sides. Accordingly, it is desirable to provide a swimming pool head having a relatively large diameter for above-the-ground swimming pools. The diameter for an above-the-ground swimming pool cleaning head should generally be much greater than that required for a below or in-the-ground swimming pool.

In addition to the above differences and requirements between in-ground and above-the-ground swimming pools, it is obvious that with a vinyl liner, a cleaning head or cleaning apparatus, including water supply hoses designed to move on the bottom of a swimming pool, is not practical for an above-the-ground swimming pool. This is again due to the possibility of tearing the vinyl.

The apparatus discussed above are all designed for below-ground swimming pools and are all designed to float on the surface of the water. The apparatus of the present invention is designed to float low in the water, with a substantial portion of the apparatus below the surface of the water for convenience in moving in a random fashion without interference with a supply hose which of necessity must also float on the surface of the water.

SUMMARY OF THE INVENTION

The apparatus described and claimed herein includes a floating head for a swimming pool cleaning system designed to float low in the water and having a diameter large enough to move in a random fashion in an above-the-ground swimming pool without interference between the sides of the swimming pool and steps extending outwardly from the sides. The apparatus includes propulsion means for moving the head in a random fashion in the swimming pool.

Among the objects of the present invention are the following:

To provide new and useful swimming pool cleaning head apparatus;

To provide new and useful floating head apparatus;

To provide new and useful floating head apparatus for an above-ground swimming pool;

To provide new and useful swimming pool cleaning head apparatus designed to float low in the water;

To provide new and useful swimming pool cleaning head apparatus having a portion which extends below the surface of the water;

To provide new and useful swimming pool cleaning head apparatus movable in a random fashion in a swimming pool; and To provide new and useful swimming pool cleaning apparatus having a propulsion system for moving randomly in a swimming pool.

DESCRIPTION OF THE PREFERRED EMBODIMENT

Figure 1:
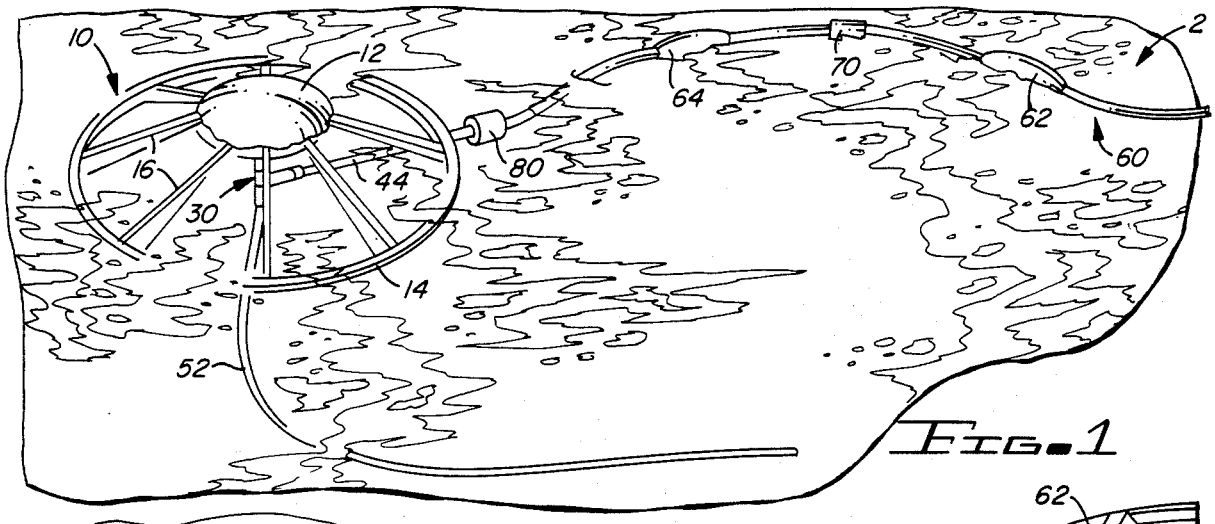
FIG. 1 is a perspective view of a portion of a swimming pool in which is disposed the apparatus of the present invention, illustrating the use environment of the apparatus of the present invention.
Figure 2:
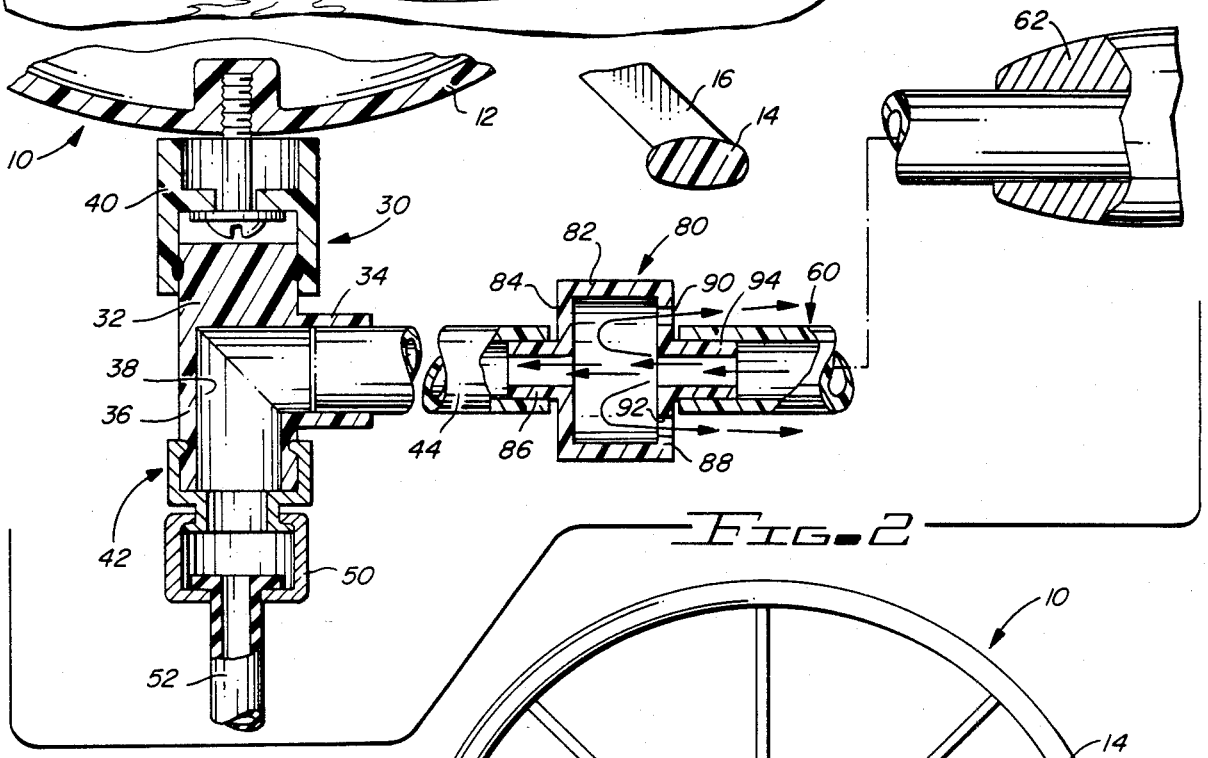
FIG. 2 is a side view in partial section of a portion of the apparatus of the present invention.
Figure 3:
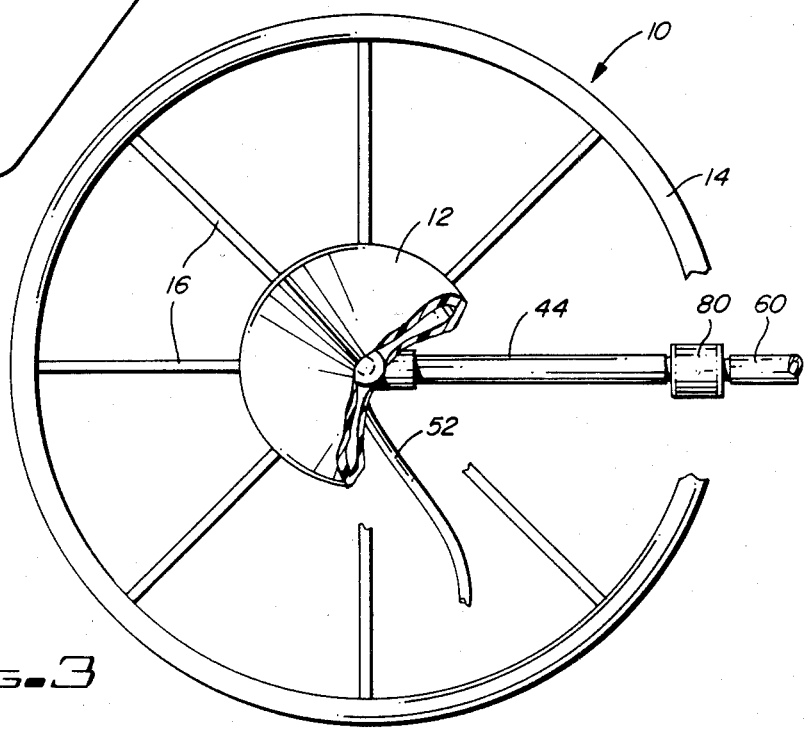
FIG. 3 is a top view, with a portion broken away, of the apparatus of the present invention.

FIG. 1 is a perspective view of a swimming pool, such as an above-the-ground swimming pool, showing water 2 in the pool. A floating head 10 of the present invention is shown floating in the water 2. A portion of the head 10 is shown above the surface of the water 2, and a portion of the head 10 is shown below the surface of the water. A water supply hose 60, supported by a plurality of floats is shown in the water extending to the head 10. FIG. 2 is a view in partial section of a portion of the head 10, the water supply hose 60, and a float 62. FIG. 3 is a top view of the head 10, with a portion broken away. For the following discussion, reference will be made to FIGS. 1, 2, and 3.

The swimming pool cleaning apparatus, of which the head 10 is a part, includes the head 10 and also the flexible water supply hose 60. The supply hose 60 is disposed on the top of the water 2 and remains there, supported by a plurality of floats, including a pair of floats 62 and 64. The floats 62 and 64 are spaced apart from each other along the hose 60. The floats aid in maintaining the hose 60 on the surface of the water 2 in the swimming pool.

The head apparatus 10 includes a center float 12 which is designed to be disposed at the surface of the water 2. Disposed downwardly from the center float 12, and spaced apart therefrom, is a circular rim 14. Extending downwardly between the float 12 and the rim 14 are a plurality of radially extending struts 16. The rim 14 is adapted to be disposed beneath the surface of the water, and thus the struts extend downwardly and outwardly from the center float 12 to the rim 14. The struts 16 are accordingly disposed substantially beneath the surface of the water 2. The diameter of the rim 14 is substantially greater than the diameter of the float 12.

Beneath the center of the float 12 is a swivel 30. The swivel 30 includes an elbow 32. The elbow 32 includes a generally horizontally extending connecting arm 34. The connecting arm 34 extends outwardly and is connected ultimately to the supply hose 60. The connecting arm 34 is secured to a connector conduit 44 which is in turn connected to a jet nozzle 80. The nozzle 80 is connected to the supply hose 60.

The elbow 32 also includes a second connecting arm 36 which extends downwardly, substantially at right angles to the horizontally extending connecting arm 34. Within the elbow 32, and extending within and communicating between the connecting arms 34 and 36 is a bore 38. The bore 38 is used to convey water from the supply hose 60 to the head 10, and downwardly beneath the head 10 through a lower swivel connector 50 to at least a single whip 52.

The swivel 30 includes two swivel portions, an upper swivel portion or connector 40 and a lower swivel portion 42. The upper swivel portion 40 comprises a connector which connects the elbow 32 to the bottom of the float 12. The upper swivel portion or connector 40 allows the elbow 32 to pivot freely, in a rotary movement, relative to the center float 12.

The lower swivel portion 42 allows the lower swivel connector 50 and the whip 52 to move relative to both the elbow 32 and the center float 12. Thus, the movement of the swivel connector 50 and the whip 52 is independent of movement of the upper swivel connector 40 and the elbow 32.

For causing movement of the head apparatus 10, there are a plurality of jet nozzles disposed on the supply hose 60. In FIG. 1 there is shown a jet nozzle 70 disposed between the floats 62 and 64. A second jet nozzle 80 is shown in the supply hose 60 disposed adjacent to the rim 14 of the head apparatus 10. The jet nozzle 80 is shown in partial section in FIG. 2. The nozzles 70 and 80 may be substantially identical.

The jet nozzle 80 includes a cylinder or cylindrical portion 82 which is generally horizontally extending. The cylinder 82 includes a front end wall 84 and a rear end wall 88. A connector 86 extends centrally forwardly from the end wall 84. The connecting conduit 44 extends between the connecting arm 34 of the elbow 32 and the front connector 86 of the jet nozzle 80.

Extending rearwardly from the end wall 88 is a second connector 94. The connector 94 is generally aligned with the connector 86. The supply hose 60 is connected to the connector 94. The connectors 86 and 94 have internal bores that serve to convey water from the supply hose 60 ultimately to the whip 52.

The jet nozzle 80 receives its jet effect from a pair of apertures 90 and 92 which extend through the end wall 88. If desired, the nozzle 80 could include more apertures than the two apertures 90 and 92 shown in the drawing.

As water flows to the supply hose 60 from an appropriate pump or source of pressurized water, not shown, the water flows through the hose 60 and through the jet nozzle 70, which is substantially identical to the jet nozzle 80. Water flowing through the jet nozzle 70 and continuing in the hose 60 then flows to the jet nozzle 80. As shown in FIG. 2 by the internal arrows in the nozzle 80, the pressurized water flows through the hose 60 and into the interior of the jet nozzle 80. Some of the water then flows outwardly through the connector 86, the connector conduit 44, and into the elbow 32. From the elbow 32, water flows through the bore 38, outwardly through the connecting arm 36, and into the swivel connector 50 and outwardly through the whip 52. The whip 52, while connected at one end to the swivel connector 50, has its opposite end free, and it thus moves freely beneath the head 10 within the swimming pool in which the apparatus 10 is disposed. As is well known and understood in the swimming pool cleaning art, the whip 50 moves in a random fashion in response to the movement of the flow of water through the whip and outwardly through its free end. The water flowing out of the free end of the whip 52 causes sediment to remain stirred up in the water. The sediment which ultimately moves to the top of the water 2 is then removed by an appropriate filter system for the pool.

The water flowing through the supply pipe 60 which does not flow out of the cylinder 82 of the jet nozzle 80 and into the connector conduit 44, flows out of the jet nozzle 80 through the apertures 90 and 92. The flow of the water out of the apertures 90 and 92 causes movement of the jet nozzle 80, and accordingly causes movement of the supply hose 60 and the head apparatus 10. The movement is, of course, random and not regular.

It will be noted, from FIGS. 1 and 3, that the diameter of the center float 12 is substantially less than that of the outer rim 14. The outer rim 14 has a relatively large diameter so that it will not be caught between the edge of the swimming pool and a ladder disposed therein. As is well known and understood in the swimming pool art, in above-the-ground pools, ladders generally extend into the pool a substantial distance. The ladders are spaced apart from the wall or liner in order to prevent damage by the ladder or by a user thereof, to the vinyl lining or liner which generally defines the outer periphery of the above-the-ground pool. Thus, the diameter of the rim 14 is large enough so that the head apparatus 10 will not be caught between the ladder and the swimming pool side, or liner. Rather, the head apparatus 10, when impinging on or against a ladder, will, due to the pivoting action of the swivel 30, which extends downwardly from the center float 12, and due to the jet nozzle 80, move away from the ladder and from the side of the swimming pool.

To insure that the head apparatus 10 moves in a random fashion in the swimming pool, the rim 14 extends downwardly below the surface of the water, and the strut 16 extends downwardly into the water from the center float 12. As indicated above, the center float 12 is the only portion of the head 10 that is partially above water. As the head apparatus 10 moves in response to action of the nozzle 80, the head apparatus 10 may come in contact with the supply hose or conduit 60, which is floating on the top of the water. With the rim 14 beneath the water, and the struts extending upwardly and inwardly from the rim 14 to the head 12, the rim 14 and struts 16 act as a cam to cause the head to move beneath the hose 60. Thus, there is no interference between the action or movement of the head apparatus 10 in the swimming pool and the supply hose 60. Rather, the head apparatus 10 simply moves beneath the hose 60 and continues to move in a random fashion. At the same time, the hose 60 also moves in a random fashion, due in part to the action of the jet nozzle 70 and also of the jet nozzle 80. The movement of the supply hose 60 increases the randomness of the movement of the head 10.

A single whip 52 is shown extending downwardly from the swivel 30. If desired, additional whips may extend downwardly from the supply hose at various locations thereon to aid in the cleaning of the swimming pool.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Swimming pool cleaning apparatus, comprising, in combination:

water supply hose means for providing a flow of water and adapted to float on the surface of water in a swimming pool;

cleaning head means connected to the water supply hose means, including a float disposed on the surface of the water, a rim having a greater diameter than the float spaced apart from the float and disposed beneath the surface of the water, and strut means extending between and connecting the float and the rim;

swivel means disposed beneath the float, including a first swivel connector connected to and movable relative to the head, and an elbow connected to the first swivel connector and receiving a flow of water from the water supply hose means;

whip means connected to the swivel means for receiving the flow of water from the elbow; and jet nozzle means connected to the water supply hose means for moving the cleaning head means randomly in the swimming pool.

2. The apparatus of claim 1 in which the water supply hose means includes a water supply hose and float means for floating the water supply hose on the surface of the water.

3. The apparatus of claim 2 in which the jet nozzle means includes at least a first jet nozzle connected to the water supply hose adjacent to the first swivel connector for moving the cleaning head means.

4. The apparatus of claim 3 in which the jet nozzle means further includes at least a second jet nozzle connected to the water supply hose remote from the first jet nozzle for moving the water supply hose randomly in the swimming pool.

5. The apparatus of claim 1 in which the strut means comprises a plurality of struts connected to the float and extending outwardly away from the float and downwardly beneath the surface of the water to the rim, and comprising, with the rim, cam means for providing a camming action between the cleaning head means and the water supply hose means to allow the cleaning head means to move beneath the water supply hose means as the cleaning head means moves randomly in the swimming pool.

6. The apparatus of claim 1 in which the swivel means further includes a second swivel connector connected to and movable relative to the elbow.

7. The apparatus of claim 6 in which the whip means is connected to the second swivel connector.

* * * * *